US009499314B2

(12) United States Patent
Fan et al.

(10) Patent No.: US 9,499,314 B2
(45) Date of Patent: Nov. 22, 2016

(54) FLEXIBLE BAG HAVING A SPOUT AND A FITMENT ASSEMBLY

(71) Applicant: Scholle Corporation, Irvine, CA (US)

(72) Inventors: Alex Fan, Suzhou Industrial Park (CN); Kyle Erickson, Chicago, IL (US)

( * ) Notice: Subject to any disclaimer, the term of this patent is extended or adjusted under 35 U.S.C. 154(b) by 121 days.

(21) Appl. No.: 14/515,982

(22) Filed: Oct. 16, 2014

(65) Prior Publication Data

US 2016/0107807 A1 Apr. 21, 2016

(51) Int. Cl.

| | |
|---|---|
| ***B65D 35/00*** | (2006.01) |
| ***B65D 47/06*** | (2006.01) |
| ***B65D 75/58*** | (2006.01) |

(52) U.S. Cl.

CPC ..... *B65D 47/06* (2013.01); *B65D 75/5877* (2013.01); *B65D 2547/066* (2013.01)

(58) Field of Classification Search

CPC ..... B65D 77/065; B65D 77/068; B65D 77/067; B65D 77/062; B65D 77/06; B65D 47/06

USPC ..... 222/92, 572, 566, 105, 106, 498, 183, 222/526, 528; 383/80; 224/148.2

See application file for complete search history.

(56) References Cited

U.S. PATENT DOCUMENTS

| | | | | |
|---|---|---|---|---|
| 5,255,713 | A * | 10/1993 | Scholle | B67D 1/0835 137/535 |
| 5,727,714 | A * | 3/1998 | Fawcett | A45F 3/16 222/175 |
| 5,884,648 | A * | 3/1999 | Savage | B67D 7/0294 137/1 |
| 5,902,294 | A * | 5/1999 | Edwards | F16K 5/0414 251/287 |
| 7,311,231 | B2 * | 12/2007 | Noell | A45F 3/20 215/388 |
| 2007/0034634 | A1 * | 2/2007 | Brown | A45F 3/16 220/703 |
| 2014/0261854 | A1 * | 9/2014 | Nemec | B67D 7/005 141/1 |

* cited by examiner

*Primary Examiner* — Lien Ngo

(74) *Attorney, Agent, or Firm* — The Watson I.P. Group, PLC; Jovan N. Jovanovic; Vladan M. Vasiljevic

(57) ABSTRACT

A spout and fitment assembly for a flexible bag. The spout comprises a base flange, a cylindrical upstand and a fitment coupling. The base flange is configured to be coupled to a flexible bag. The cylindrical upstand extends from the base flange. The cylindrical upstand defines a passageway therealong which is placeable in fluid communication with the flexible bag. The fitment coupling extends from the cylindrical upstand between the proximal end and the distal end thereof. The fitment assembly comprises a fitment body and a hose. The hose is coupled to the hose connection portion. The connector portion is sealingly engaged with the fitment coupling so as to place the inner bore in fluid communication with the passageway of the cylindrical upstand.

20 Claims, 9 Drawing Sheets

FLEXIBLE BAG HAVING A SPOUT AND A FITMENT ASSEMBLY

CROSS-REFERENCE TO RELATED APPLICATION

Not Applicable

BACKGROUND OF THE DISCLOSURE

1. Field of the Disclosure

The disclosure relates in general to flexible packaging, and more particularly, to a flexible bag having a spout and a fitment assembly. Such a flexible bag is configured for filling through the spout and dispensing through a fitment that is coupled to the spout.

2. Background Art

The use of flexible packaging is known in the art for the packaging and dispensing of flowable material. Typically, such a flexible packaging includes a flexible bag to which a spout is coupled. A cap is placed over the spout. For many flowable materials, such as low acid applications, it is necessary to place the package within an aseptic chamber during filling. The package essentially enters into a chamber where the cap is removed. It is then filled with the flowable material through the spout. At the conclusion, the cap is repositioned.

In many applications, the flowable material is dispensed through a hose that is coupled to the valve. Such a hose is typically integrated into the cap and generally extends away from the cap in a direction that is perpendicular to the flexible bag. Problematically, dispensers which include such elongated hose members have difficulty fitting within the chamber for filling.

To overcome this problem, one solution has been the utilization of a first cap over the spout for filling, and a second cap over the spout having a hose coupled thereto utilized after filling. The first cap does not include a hose, and thus does not negatively impact the insertion of the flexible package into the chamber for filling. The second cap having the hose is only placed onto the spout after filling.

Unfortunately, the use of two separate caps (both of which must be aseptic) increases the complexity associated with filling such flowable material into such flexible packages. That is, the complete package requires two separate caps which are utilized at different points in the life of the flexible packaging. Additionally, the cost of utilizing such a solution with two separate caps has led to increased cost.

SUMMARY OF THE DISCLOSURE

The disclosure is directed to a spout and fitment assembly for a flexible bag. The spout comprises a base flange, a cylindrical upstand and a fitment coupling. The base flange is configured to be coupled to a flexible bag. The cylindrical upstand extends from the base flange. The cylindrical upstand defines a passageway therealong which is placeable in fluid communication with the flexible bag. The cylindrical upstand has a proximal end and a distal end. The fitment coupling extends from the cylindrical upstand between the proximal end and the distal end thereof. It is spaced apart from the base flange. The fitment coupling includes a connection receiver that is in fluid communication with the passageway of the cylindrical upstand. The fitment assembly comprises a fitment body and a hose. The fitment body has a connector portion and a hose connection portion with an inner bore extending therethrough. The hose is coupled to the hose connection portion. The hose has a first end extending over the hose connection portion and a second end. A bore extends at least partially therethrough which is placeable in fluid communication with the inner bore of the fitment body. The connector portion is sealingly engaged with the fitment coupling so as to place the inner bore in fluid communication with the passageway of the cylindrical upstand.

In some configurations, the spout further includes a lower body flange that is spaced apart from the base flange. The fitment coupling is positioned between the base flange and the lower body flange.

In some configurations, a substantially planar fitment surface is positioned between the lower body flange and the base flange. The fitment coupling extends from the fitment surface.

In some configurations, the fitment coupling extends from the fitment surface substantially perpendicular thereto.

In some configurations, the fitment coupling is substantially tangent to the cylindrical upstand, and substantially about a midpoint thereof.

In some configurations, the spout further includes a guide surface extending between the base flange and the lower body flange. The guide surface is substantially perpendicular to the fitment surface.

In some configurations, the guide surface is substantially tangent to the cylindrical upstand, substantially about a midpoint thereof.

In some configurations, the cylindrical upstand has a substantially uniform thickness.

In some configurations, the fitment coupling comprises a connection receiver extending from the cylindrical upstand, and terminating at an outer rim. The outer rim has a substantially circular cross-sectional configuration.

In some configurations, the outer rim includes at least one slot. The fitment body of the fitment assembly has at least one keying notch configured to engage the at least one slot, upon proper joining of the fitment body with the fitment coupling.

In some configurations, a cap sealingly engages the distal end of the cylindrical upstand.

In another aspect of the disclosure, the disclosure is directed to a flexible bag which includes a plurality of panels coupled together by way of seals to define a cavity. An opening is defined in one of the plurality of panels. A spout comprising a base flange, a cylindrical upstand and a fitment coupling is configured to be coupled to a flexible bag. The cylindrical upstand extends from the base flange. The cylindrical upstand defines a passageway therealong which is placeable in fluid communication with the flexible bag. The cylindrical upstand has a proximal end and a distal end. The fitment coupling extends from the cylindrical upstand between the proximal end and the distal end thereof. It is spaced apart from the base flange. The fitment coupling includes a connection receiver that is in fluid communication with the passageway of the cylindrical upstand. The fitment assembly comprises a fitment body and a hose. The fitment body has a connector portion and a hose connection portion with an inner bore extending therethrough. The hose is coupled to the hose connection portion. The hose has a first end extending over the hose connection portion and a second end. A bore extends at least partially therethrough which is placeable in fluid communication with the inner bore of the fitment body. The connector portion is sealingly engaged with the fitment coupling so as to place the inner bore in fluid communication with the passageway of the cylindrical upstand.

In some configurations, the spout further includes a lower body flange spaced apart from the base flange. The fitment coupling extends from the cylindrical upstand between the lower body flange and the base flange.

In some configurations, the fitment coupling extends substantially perpendicular to the cylindrical upstand, so as to be substantially parallel to the base flange.

In some configurations, the flexible bag comprises a substantially rectangular configuration with a top seal, a bottom seal, a first side seal and a second side seal defining a substantially rectangular configuration. The fitment coupling extends from the cylindrical upstand substantially perpendicular to the first side seal and the second side seal, and substantially parallel to the bottom seal.

In some configurations, the hose extends beyond the bottom seal.

In some configurations, the flexible bag defines a footprint, with the hose remaining within the footprint of the flexible bag.

In some configurations, a substantially planar fitment surface is positioned between the lower body flange and the base flange. The fitment coupling extends from the fitment surface.

In some configurations, the fitment coupling extends from the fitment surface substantially perpendicularly thereto.

In some configurations, the fitment coupling is substantially tangent to the cylindrical upstand, substantially about a midpoint thereof.

BRIEF DESCRIPTION OF THE DRAWINGS

The disclosure will now be described with reference to the drawings wherein.

DETAILED DESCRIPTION OF THE DISCLOSURE

Figure 1:
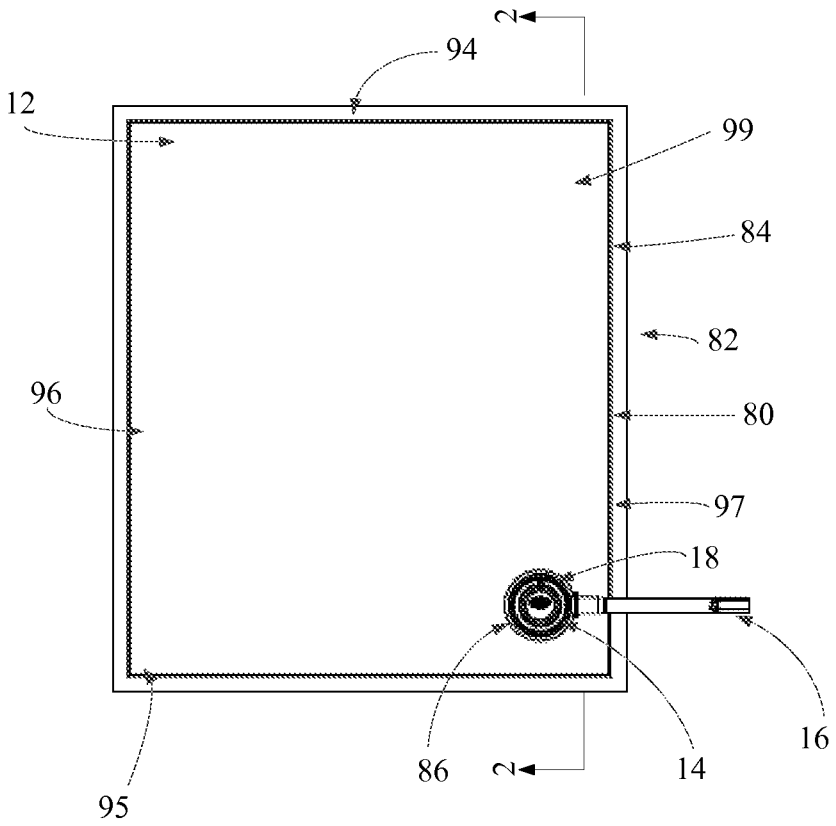
FIG. 1 of the drawings is top plan view of a flexible bag having a spout, cap and fitment assembly of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, a flexible bag having a spout and fitment assembly of the present disclosure is shown. The structure includes flexible bag 12, spout 14, fitment assembly 16 and cap 18. The bag assembly is often placed within a rigid outer container, often termed a bag-in-box package. Such packaging is often utilized for different flowable materials, such as, including, but not limited to, chemicals, detergents, drink syrups, mixes, purees, gels and the like. Typically, a valve is provided within which the hose 104 of the fitment assembly extends. The valve selectively crushes the hose to preclude or to allow flow of flowable material therefrom. While not required, often, the flow of flowable material is achieved through gravity or through pressure exerted on the flexible bag.

Figure 2:
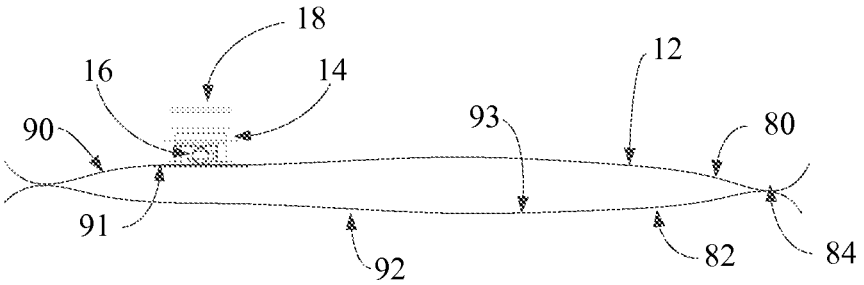
FIG. 2 of the drawings is a cross-sectional view of the flexible bag having a spout, cap and fitment assembly of the present disclosure, showing, in particular the barrier spout of the present disclosure, taken generally about lines 2-2 of FIG. 1.
Figure 3:
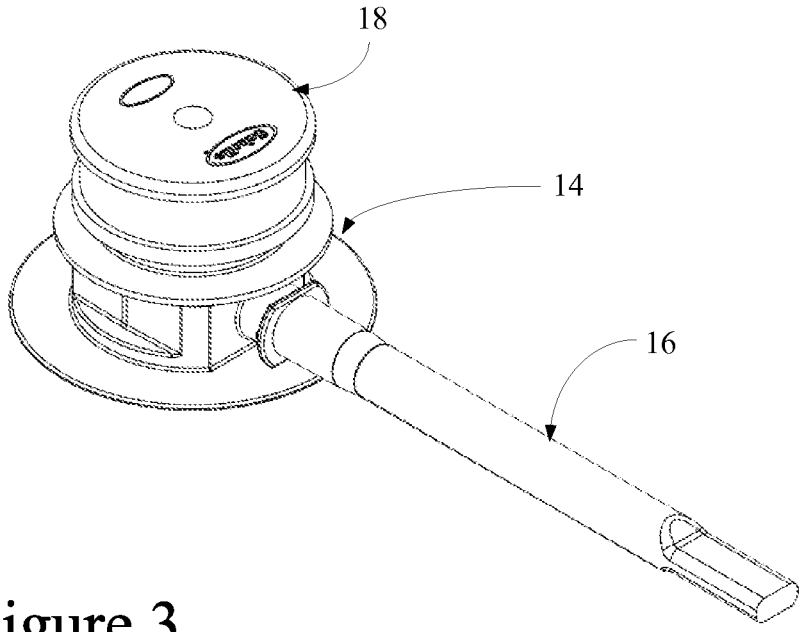
FIG. 3 of the drawings is a perspective view of the spout, cap and fitment assembly of the present disclosure.
Figure 4:
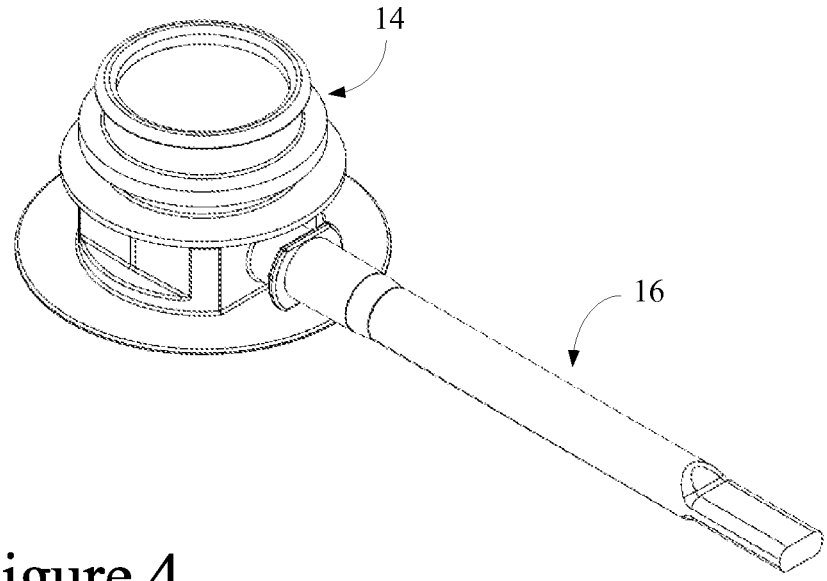
FIG. 4 of the drawings is a perspective view of the spout and fitment assembly of the present disclosure, showing, in particular, the removal of the cap.
Figure 5:
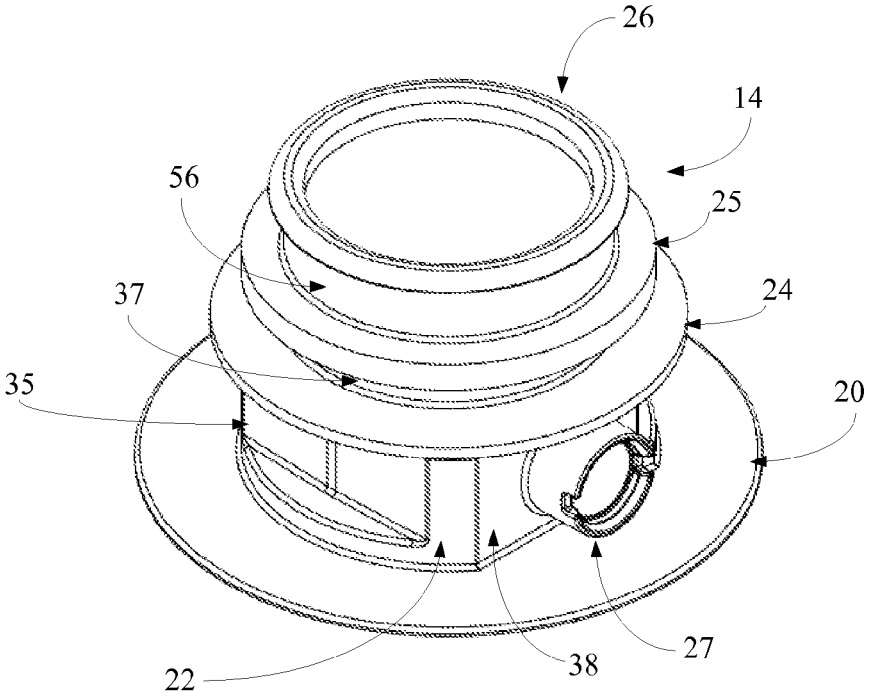
FIG. 5 of the drawings is a perspective view of the spout of the present disclosure, showing, in particular the fitment coupling thereof.
Figure 6:
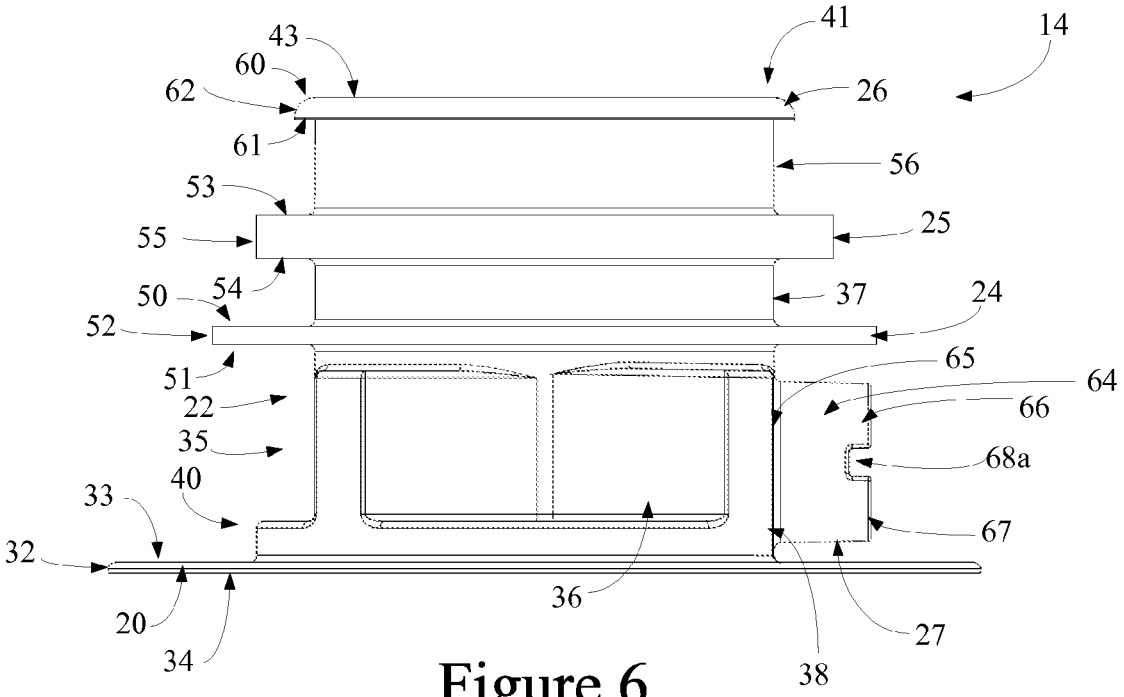
FIG. 6 of the drawings is a side elevational view of the spout of the present disclosure.
Figure 7:
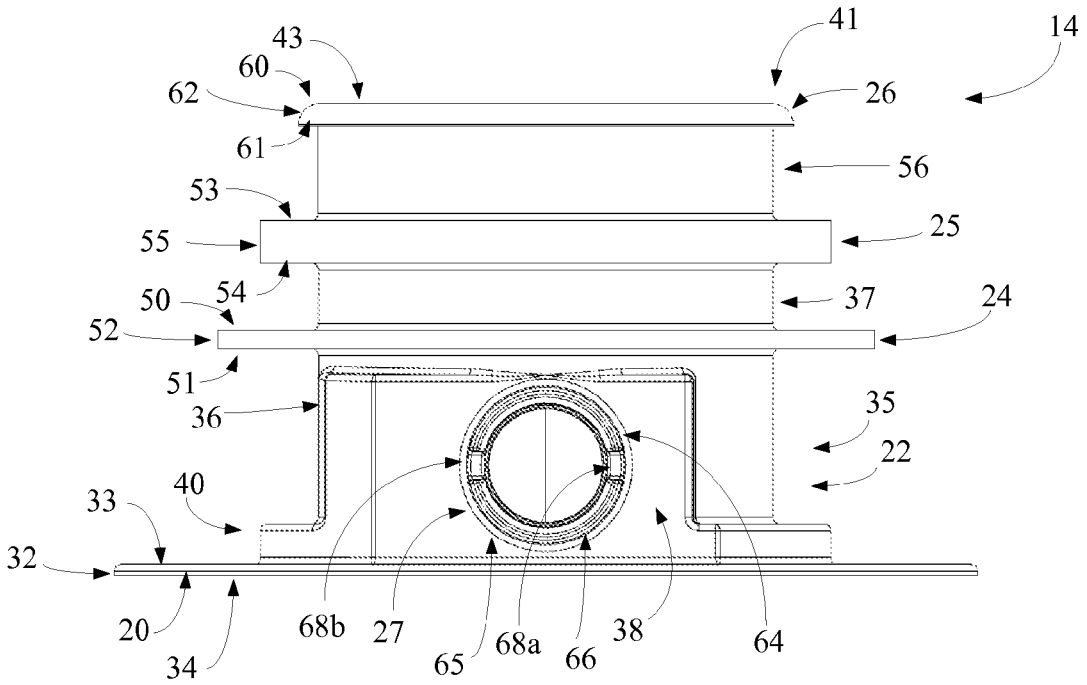
FIG. 7 of the drawings is a front side elevational view of the spout of the present disclosure.
Figure 8:
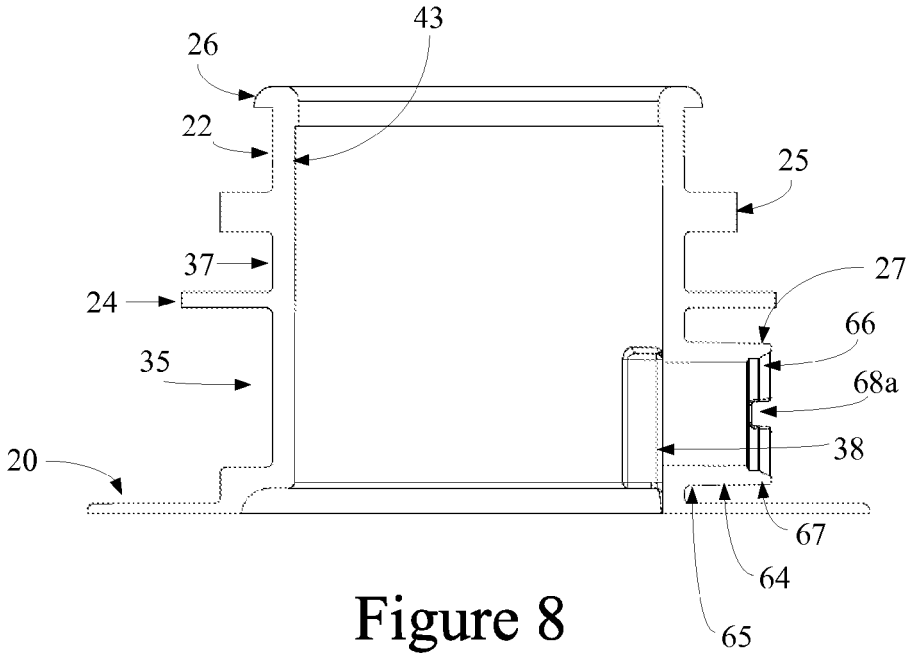
FIG. 8 of the drawings is a cross-sectional view of the spout of the present disclosure.

The flexible bag 12 may comprise any number of different configurations and different materials. For example, and not limited thereto, the flexible bag 12 is shown in FIGS. 1 and 2 as comprising a pillow type bag formed from a single ply or multiple plies of polymer based film (which may be metallized or otherwise treated). Such a bag includes front panel 80 and back panel 82. Front panel 80 includes outer surface 90 and inner surface 91. The back panel 82 includes outer surface 92 and inner surface 93. The front and back panel are positioned in an overlying orientation so that the inner surfaces face each other. It will be understood that while a generally rectangular inner bag is shown, a bag of a different shape, such as a shape that mates with the cavity portion of the outer soft box may be utilized.

The panels are then coupled together by way of seals 84. In the case of a pillow type container, the seals 84 include a top seal 94, bottom seal 95, first side seal 96 and second side seal 97. The seals are generally perpendicular to adjacent seals and parallel to opposing seals to generally define a square or rectangular configuration, thereby defining a generally square or rectangular cavity 99. The seals may be formed through the application of heat, or through other procedures, including, but not limited to RF welding, ultrasonic welding, adhesive, among others. The disclosure is not limited to any particular manner of attachment of the panels.

For many pillow type containers, an opening 86 is provided through the front panel 80 proximate, but spaced apart from the bottom seal 95. The spout 14 can be coupled thereto in sealed engagement.

The spout 14 and the fitment assembly 16 is shown in more detail in FIGS. 3, 4, 10 and 11. The spout 14 is shown in greater detail in FIGS. 5 through 9 as comprising base flange 20, cylindrical upstand 22, lower body flange 24, upper body flange 25, upper annular rim flange 26 and fitment coupling 27. The base flange 20 includes lower surface 34, top surface 33 and outer surface 32. As will be understood to those of skill in the art, the base flange is coupled to the container body (i.e., typically a conventional pillow-type container) through welding, adhesion or other system typically joining the upper surface to the inside of the panels. The cylindrical upstand 22 extends upwardly from the base flange 20, positioned at a proximal end 40 thereof, and extends generally orthogonal thereto toward distal end 41. Typically, the cylindrical upstand is substantially uniform in cross-section and the inner surface defines a passageway with an opening at either end which provides fluid communication with the cavity of the container. An upper opening is positioned at the distal end, and a lower opening is positioned at the proximal end. While termed cylindrical, elliptical as well as other shapes are contemplated.

The lower body flange 24 includes upper surface 50, lower surface 51 and outer surface 52. The lower body flange is spaced apart from the base flange and is generally parallel thereto. Thus, a lower channel 35 is defined between the flanges. Filling equipment and dispensing coupling equipment may be configured to grasp the spout 14 about the geometry defined by the defined lower channel and the associated flanges. In the embodiment shown, the lower body flange is of a diameter smaller than the base flange. It will be understood that variations are contemplated.

Figure 9:
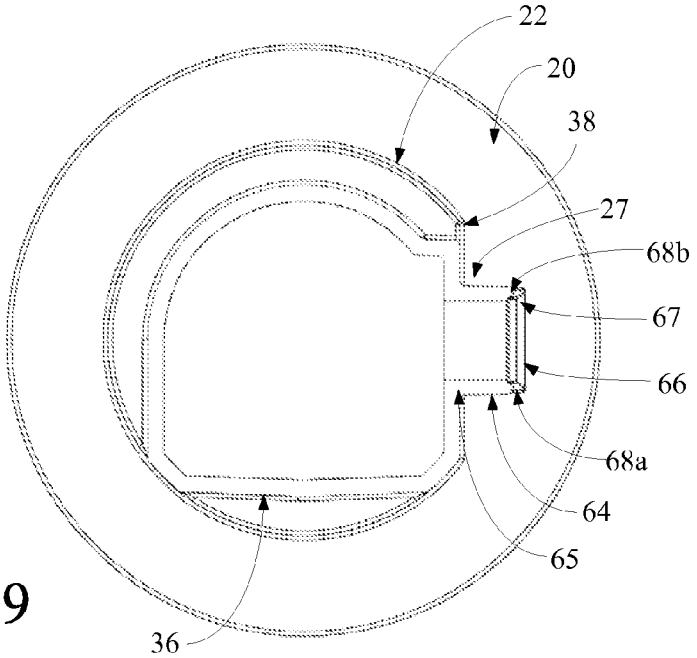
FIG. 9 of the drawings is a top cross-sectional view of the spout of the present disclosure.
Figure 10:
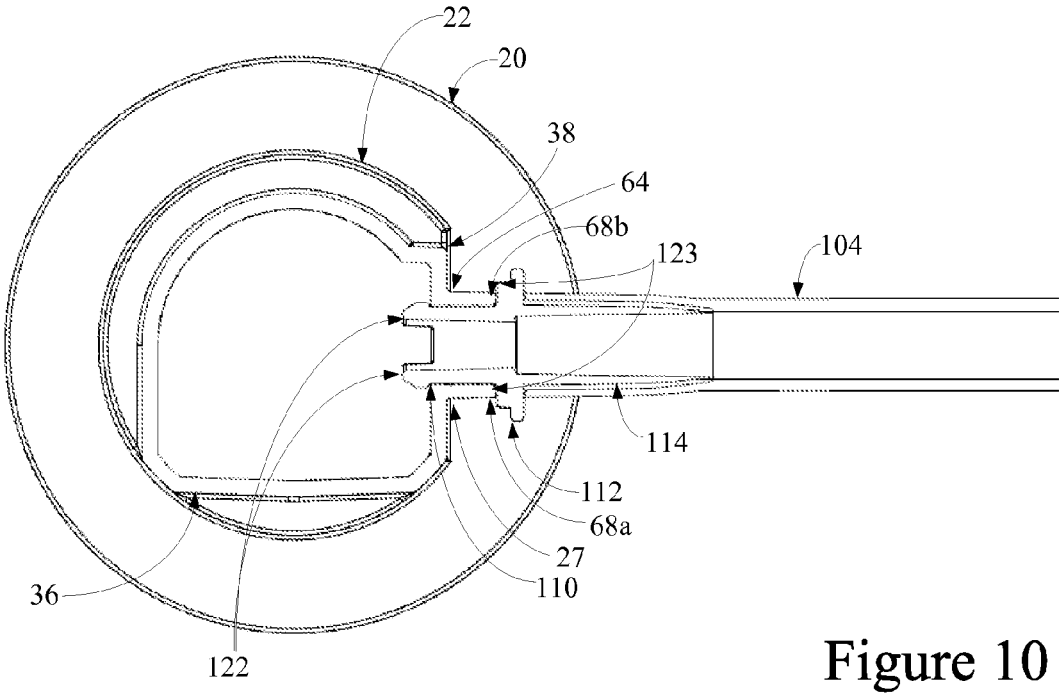
FIG. 10 of the drawings is a partial top cross-sectional view of the spout and fitment assembly of the present disclosure.
Figure 11:
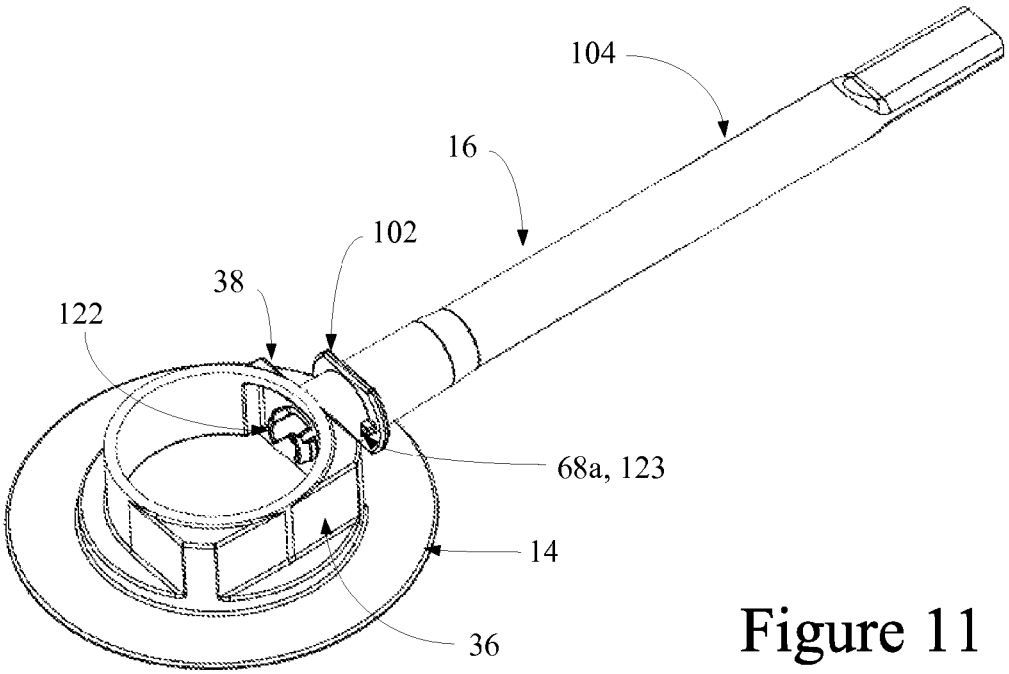
FIG. 11 of the drawings is a cross-sectional perspective view of the spout and the fitment assembly of the present disclosure, showing, in particular, the coupling of the fitment assembly to the fitment coupling from within the cylindrical upstand.
Figure 12:
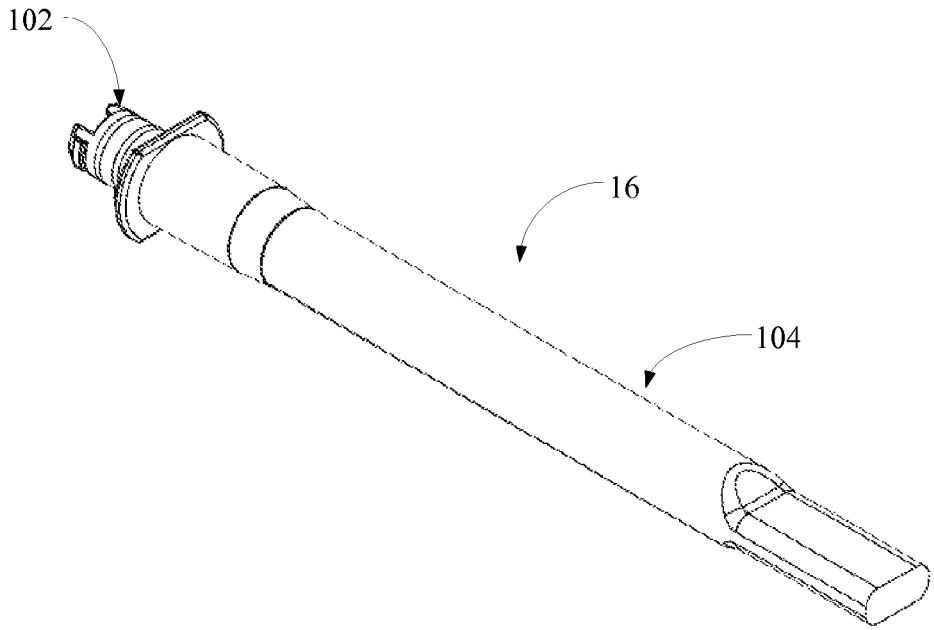
FIG. 12 of the drawings is a perspective view of the fitment assembly of the present disclosure.

The lower channel 35 includes guide surface 36 which comprises a flattened surface on the otherwise circular cross-sectional configuration, and fitment surface 38 which also comprises a flattened surface on the otherwise circular cross-sectional configuration. The two surfaces are oriented so as to be generally perpendicular to each other. Additionally, the guide surface is tangent to the generally circular cross-sectional configuration at a midpoint thereof. Similarly, the fitment surface 38 is tangent to the generally circular cross-sectional configuration at a midpoint thereof. The guide surface is disposed on the lower channel 35 terminating in a spaced apart relationship from the base flange 20 and the lower body flange 24. The fitment surface extends from the base flange while the upper end thereof is spaced apart from the lower surface of the lower body flange. The thickness of the cylindrical upstand remains generally uniform across the lower channel 35, and, as such, the cross-sectional configuration of the cylindrical upstand takes a partially square configuration due to the guide surface and fitment surface. Such a configuration is shown in FIG. 9.

The upper body flange 25 includes upper surface 53, lower surface 54 and outer surface 55. The upper body flange is spaced apart from the lower body flange 24 a predetermined distance and is generally parallel thereto. Thus, a generally uniform central channel 37 is defined therebetween. In the configuration shown, the lower channel 35 is wider than the central channel 37. The outer surface 52 of the lower body flange is thinner than the outer surface 55 of the upper body flange 25. The diameter of the upper body flange is smaller than that of the lower body flange. The central channel 37 is generally uniformly cylindrical.

The upper annular rim flange 26 extends about the distal end of the cylindrical upstand 22. In the embodiment shown, the upper annular rim flange 26 includes upper surface 60, lower surface 61 and outer surface 62. The upper annular rim is positioned at or near the distal end 41 of the cylindrical upstand. In the configuration shown, the upper annular rim is positioned at the uppermost end of the cylindrical upstand and defines the distal end of the spout. As will be explained below, the upper annular rim flange provides the structure for coupling the cap 18 thereto.

An upper channel 56 is defined between the upper body flange 25 and the upper annular rim flange 26. The upper channel 56 is generally of the same diameter as the central channel 37. The width of the upper channel 56 is less than that of the lower channel 35, but generally larger than that of the central channel 37. Thus, the central channel 37 is of the smallest width with the lower channel 35 being of the largest width.

The fitment coupling 27 extends from the fitment surface 38 generally perpendicular thereto. The fitment coupling 27 comprises a connection receiver 64. The connection receiver is a generally cylindrical member having a proximal end 65 and a distal end 67. At the distal end thereof the connection receiver defines an outer rim 66 that is generally parallel to the fitment surface. The outer rim 66 includes a keying member, which, in the configuration shown, comprises a pair of opposing slots 68*a*, 68*b*. The slots have a generally square configuration, however, other configurations are likewise contemplated.

In the configuration shown, the distance between the proximal end and the distal end generally matches the diameter of the lower body flange. As the outer rim 66 is generally parallel to the fitment surface, the sides of the distal end of the connection receiver extend beyond the footprint of the lower body flange 24.

The fitment assembly 16 and the components thereof are shown in FIGS. 12 through 16 as comprising fitment body 102 and hose 104. The coupling of the fitment assembly to the spout is shown in greater detail in FIGS. 10 and 11. The fitment body 102 which is shown in greater detail in FIGS. 15 and 16, includes connector portion 110, flange 112, and hose connector 114. An inner bore 116 extends through the fitment body 102 to each of the ends thereof. The connector portion 110 includes proximal end 120 and distal end 121. At a distal end thereof, extending from the first side of the flange 112, a pair of axial tabs 122 are positioned which are configured to interface with the inner side of the fitment surface 38. The outer surface of the connector portion includes a plurality of raised rings 124 which form a seal with the connection receiver of the fitment coupling.

The flange 112 includes first side 130, second side 131 and outer periphery 132. The outer periphery includes flattened regions 134, 135 which correspond to the upper and lower ends of the fitment surface 32.

The hose connection portion 114 extends from the second side 131 of the flange 112 and includes outer surface 140. The outer surface generally tapers at the distal end to allow for the connecting of the hose 104 thereover.

The inner bore 116 extends through the entirety of the fitment body and includes a generally uniform cross-sectional configuration, although variations thereto are contemplated.

Figure 13:
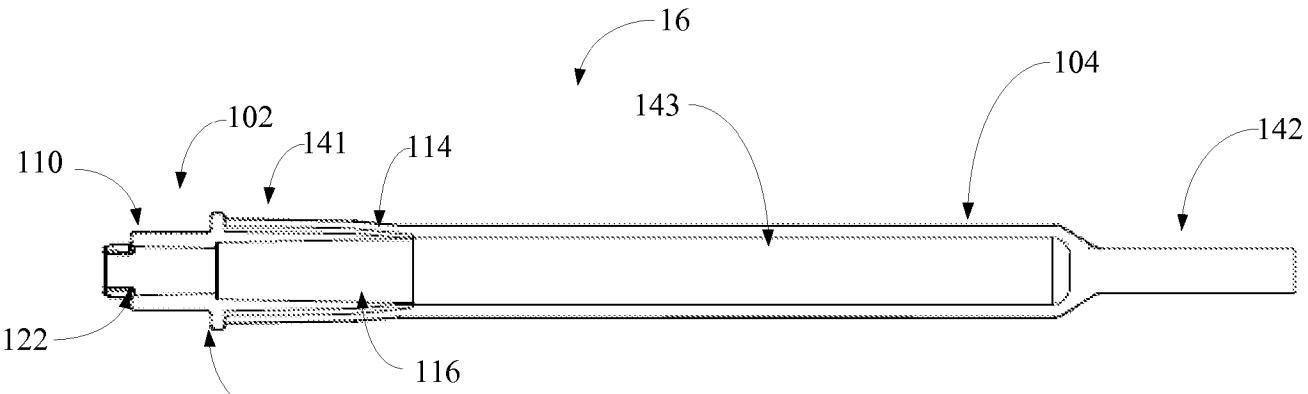
FIG. 13 of the drawings is a side cross-sectional view of the fitment assembly of the present disclosure.
Figure 14:
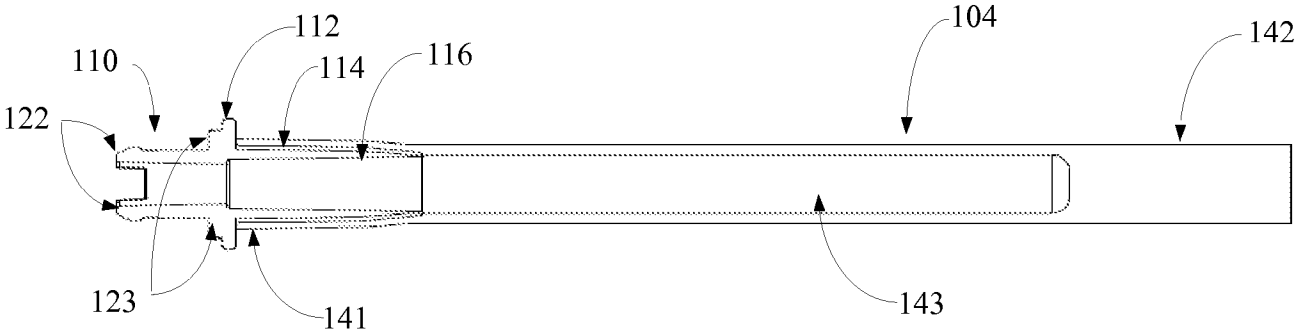
FIG. 14 of the drawings is a top cross-sectional view of the fitment assembly of the present disclosure.
Figure 15:
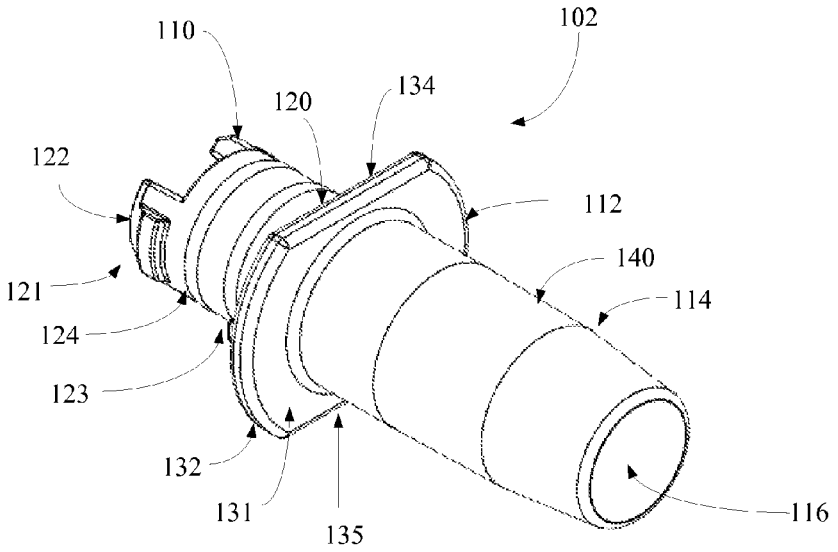
FIG. 15 of the drawings is a front perspective view of the fitment body of the fitment assembly of the present disclosure.
Figure 16:
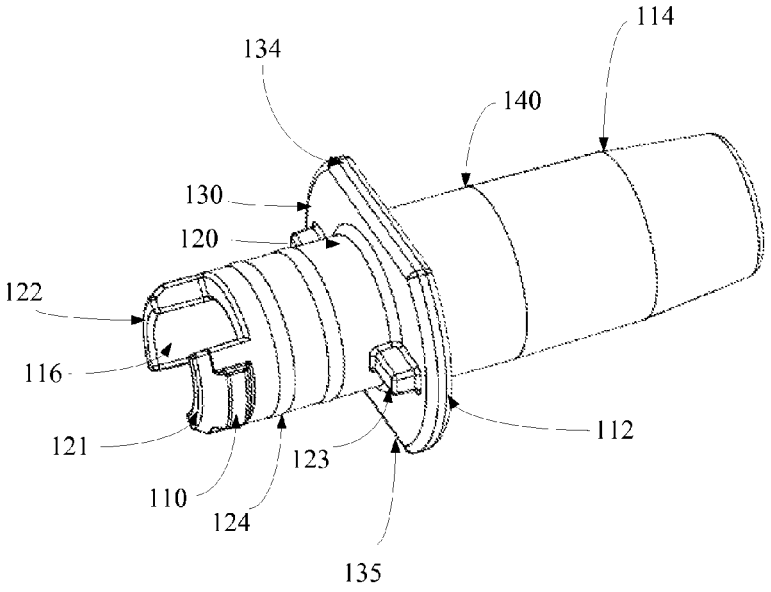
FIG. 16 of the drawings is a back perspective view of the fitment body of the fitment assembly of the present disclosure.
Figure 17A:
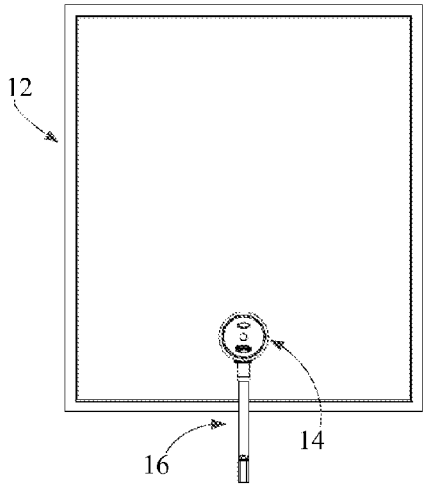
FIGS. 17*a* through 17*d* of the drawings are top plan views of a flexible bag and spout having a fitment assembly with various positions of the spout and various orientations of the fitment assembly, wherein it will be understood that other variations are likewise contemplated with the variations shown being solely exemplary and not limiting.
Figure 17B:
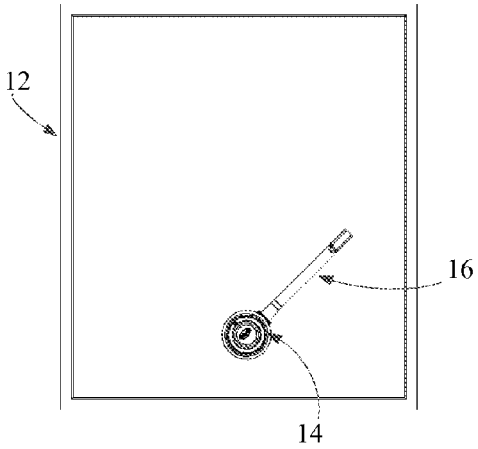
Figure 17C:
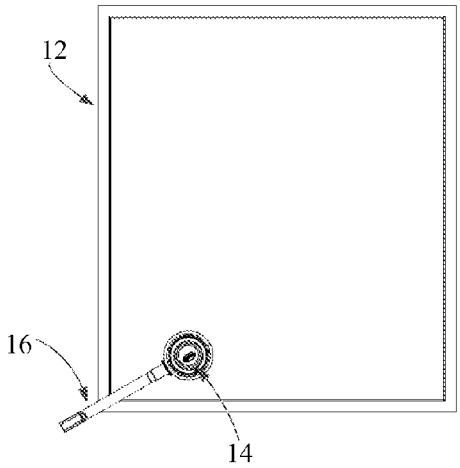
Figure 17D:
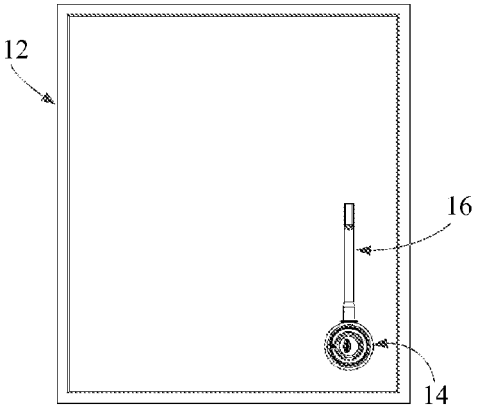

The hose 104 which is shown in greater detail in FIGS. 13 and 14, includes first end 141, second end 142 and bore 143. The first end 141 is positioned over the hose connection portion 114 (and may be co-molded, overmolded, welded, or sealingly engaged) through an interference fit and the resilience of the hose material. The second end of the hose is preferably closed. It is therefore necessary to cut the second end to have fluid communication with the bore 143. The bore 143 is in fluid communication with the inner bore 116 at the first end thereof. While the hose is contemplated as being a flexible SBS or SEBS polymer material, a number of other materials are contemplated. In addition, while the hose is shown as being substantially linear, other configurations are contemplated.

Referring again to FIG. 3, cap 18 is removably positioned over the passageway defined by the cylindrical upstand 22 at the distal end thereof. It will be understood that portions of the outer rim of the cap sealingly engage the upper annular rim flange 26 of the spout to seal the passageway. It is preferred that such a seal be a hermetic seal which is fluid tight.

In operation, the flexible bag 12 portion is first provided. To the flexible bag 12, spout 14 is coupled so as to seal opening 86 and to provide ingress and egress to and from cavity 99. It will be understood that the position of the opening 86 and the resulting position of the spout 14 can be varied and are not limited to the position and orientation shown in the configuration shown in the drawings.

The hose 104 is coupled to the hose connection portion 114 through a number of different operations, depending on the manner and type of attachment. The two are engaged in a fluid tight configuration. Once coupled, the fitment body is coupled to the fitment coupling 27 of the spout 14. In particular, the connector portion 110 of the fitment body is directed into the connection receiver 64 of the fitment coupling 27. Continued insertion thereof directs the keying notches 123 into the respective slots 68*a*, 68*b* at the same time that the axial tabs 122 of the connector portion 110 extend beyond the connection receiver and engage the back side of the fitment surface. The configuration of the axial tabs 122 is such that insertion can be achieved with a predetermined force, but once the axial tabs have engaged the back side of the fitment surface, removal is generally precluded without excessive force, or destruction of the component. This may not be the case with all embodiments, as certain embodiments are contemplated wherein the removal can be easily achieved when desired.

In the configuration shown in FIG. 1, the orientation of the spout is such that the fitment assembly 16 extends perpendicular to the first and second side seals 96, 97, parallel to the bottom seal 95, traversing the side seal 97. In other embodiments, the spout may be oriented in a different direction, with the resulting fitment assembly extending in a different direction. For example, and with reference to FIGS. 17*a* through 17*d*, a number of different configurations are shown for the position of the spout 14 relative to the flexible bag 12 and the fitment assembly 16 relative to the spout and the bag. These are merely exemplary of some of the vast multitude of different configurations and are not to be deemed limiting. It will further be understood that the hose may be curved or have a shape other than linear such that the orientation of the spout and the position of the fitment can be varied. Indeed, even with a linear hose, the hose may be at any orientation about the outer surface of the cylindrical upstand of the spout.

It will also be understood that while the fitment coupling extends generally perpendicular to the cylindrical upstand, other configurations (such as configurations wherein the fitment coupling is oblique to the cylindrical upstand) are contemplated. In addition, while the fitment coupling is shown as being substantially uniform, a bend, or other change in direction thereof is contemplated. Furthermore, while the fitment coupling is shown as extending generally tangentially from the cylindrical upstand proximate, it is contemplated that the fitment coupling may be offset as desired from such an orientation.

It will be understood that the hose may be moved, tied down and/or taped to the bag so as to be within the footprint of the bag (and not generally loose) so that the hose remains in a desired orientation during assembly, filling and shipping, for example.

Once fully assembled, the bag may be irradiated to as to be sterilized internally. The cap can be removed within a sterile filler and the bag may be filled. The cap can be returned over the spout and the bag is ready for shipping. When inserted into a rigid container, and when the hose is coupled to a valve, the flowable material within the flexible bag can be emptied. Advantageously, there is no need to supply multiple caps, that is caps prior to filling, and caps with hoses coupled thereto after filling. Thus, the quantity of parts and the need for additional components can be minimized. The entire bag may be shipped irradiated and ready for filling wherein no additional outside components (such as different caps or the like) are required.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A spout and fitment assembly for a flexible bag, the spout comprising:

a base flange configured to be coupled to a flexible bag;

a cylindrical upstand extending from the base flange, the cylindrical upstand defining a passageway therealong placeable in fluid communication with the flexible bag, the cylindrical upstand having an opening at a proximal end and an opening at a distal end, to allow for fluid passage therethrough;

a fitment coupling extending from the cylindrical upstand between the proximal end and the distal end thereof, and spaced apart from the base flange, the fitment coupling including a connection receiver that is in fluid communication with the passageway of the cylindrical upstand;

the fitment assembly comprising:

fitment body having a connector portion and a hose connection portion with an inner bore extending therethrough, and a hose coupled to the hose connection portion, the hose having a first end extending over the hose connection portion and a second end, with a bore extending at least partially therethrough placeable in fluid communication with the inner bore of the fitment body, wherein the connector portion is sealingly engaged with the fitment coupling so as to place the inner bore in fluid communication with the passageway of the cylindrical upstand.

2. The spout and fitment assembly of claim 1 wherein the spout further includes a lower body flange spaced apart from the base flange, the fitment coupling positioned between the base flange and the lower body flange.

3. The spout and fitment assembly of claim 2 wherein a substantially planar fitment surface is positioned between the lower body flange and the base flange, with the fitment coupling extending from the fitment surface.

4. The spout and fitment assembly of claim 3 wherein the fitment coupling extends from the fitment surface substantially perpendicularly thereto.

5. The spout of claim 4 wherein the fitment coupling is substantially tangent to the cylindrical upstand, substantially about a midpoint thereof.

6. The spout and fitment assembly of claim 4 wherein the spout further includes a guide surface extending between the base flange and the lower body flange, the guide surface being substantially perpendicular to the fitment surface.

7. The spout and fitment assembly of claim 6 wherein the guide surface is substantially tangent to the cylindrical upstand, substantially about a midpoint thereof.

8. The spout and fitment assembly of claim 2 wherein the cylindrical upstand has a substantially uniform thickness.

9. The spout and fitment assembly of claim 1 wherein the fitment coupling comprises a connection receiver extending from the cylindrical upstand, and terminating at an outer rim, which has a substantially circular cross-sectional configuration.

10. The spout and fitment assembly of claim 9 wherein the outer rim includes at least one slot, with the fitment body of the fitment assembly having at least one keying notch configured to engage the at least one slot, upon proper joining of the fitment body with the fitment coupling.

11. The spout and fitment assembly of claim 1 wherein a cap sealingly engages the distal end of the cylindrical upstand.

12. A flexible bag comprising:

a plurality of panels which are coupled together by way of seals to define a cavity, and, an opening defined in one of the plurality of panels;

a spout comprising:

a base flange configured to be coupled to a flexible bag and positioned so as to be in fluid communication with the cavity by way of the opening;

a cylindrical upstand extending from the base flange, the cylindrical upstand defining a passageway therealong placeable in fluid communication with the flexible bag through the opening thereof, the cylindrical upstand having an opening at a proximal end and an opening at a distal end, to allow for fluid passage therethrough;

a fitment coupling extending from the cylindrical upstand between the proximal end and the distal end thereof, and spaced apart from the base flange, the fitment coupling including a connection receiver that is in fluid communication with the passageway of the cylindrical upstand; and a fitment assembly comprising:

fitment body having a connector portion and a hose connection portion with an inner bore extending therethrough, and a hose coupled to the hose connection portion, the hose having a first end extending over the hose connection portion and a second end, with a bore extending at least partially therethrough placeable in fluid communication with the inner bore of the fitment body, wherein the connector portion is sealingly engaged with the fitment coupling so as to place the inner bore in fluid communication with the passageway of the cylindrical upstand.

13. The flexible bag of claim 12 wherein the spout further includes a lower body flange spaced apart from the base flange, with the fitment coupling extending from the cylindrical upstand between the lower body flange and the base flange.

14. The flexible bag of claim 12 wherein the fitment coupling extends substantially perpendicular to the cylindrical upstand, so as to be substantially parallel to the base flange.

15. The flexible bag of claim 14 wherein the flexible bag comprises a substantially rectangular configuration with a top seal, a bottom seal, a first side seal and a second side seal defining a substantially rectangular configuration, the fitment coupling extending from the cylindrical upstand substantially parallel to the first side seal and the second side seal, and substantially perpendicular to the bottom seal.

16. The flexible bag of claim 15 wherein the hose extends beyond the bottom seal.

17. The flexible bag of claim 12 wherein the flexible bag defines an outer perimeter, with the hose remaining within the outer perimeter of the flexible bag.

18. The flexible bag of claim 12 wherein a substantially planar fitment surface is positioned between the lower body flange and the base flange, with the fitment coupling extending from the fitment surface.

19. The flexible bag of claim 18 wherein the fitment coupling extends from the fitment surface substantially perpendicularly thereto.

20. The flexible bag of claim 19 wherein the fitment coupling is substantially tangent to the cylindrical upstand, substantially about a midpoint thereof.

* * * * *